US005361702A

United States Patent [19]

Goetz

[11] Patent Number: 5,361,702

[45] Date of Patent: Nov. 8, 1994

[54] MECHANICAL SHIELDING FOR ELECTRIC PRIMER

[75] Inventor: Raymond J. Goetz, Baltimore, Md.

[73] Assignee: The United States of America as represented by the Secretary of the Navy, Washington, D.C.

[21] Appl. No.: 42,924

[22] Filed: Apr. 2, 1993

[51] Int. Cl.[5] ..... F42B 5/08; F42C 19/12

[52] U.S. Cl. ..... 102/472; 102/202.5

[58] Field of Search ..... 102/472, 204, 202.8, 102/202.5

[56] References Cited

U.S. PATENT DOCUMENTS

| | | | |
|---|---|---|---|
| 3,018,732 | 1/1962 | Tognola | 102/202.8 |
| 3,090,310 | 5/1963 | Peet et al. | 102/472 |
| 3,455,244 | 7/1969 | Ballreich et al. | 102/472 |
| 4,329,924 | 5/1982 | Logofun | 102/202.8 |
| 4,386,567 | 6/1983 | Ciccone et al. | 102/202.5 |
| 4,605,453 | 8/1986 | Spear et al. | 102/204 |

*Primary Examiner*—David H. Brown
*Attorney, Agent, or Firm*—Jacob Shuster

[57] ABSTRACT

An electric primer for cartridge ammunition is designed to minimize antenna coupling, capacitive coupling, and aperture coupling of stray electromagnetic radiation thereinto to avoid accidental primer detonation with resulting ignition of cartridge propellant. The primer is provided with a button electrode deeply recessed totally behind a small diameter access aperture which physically guards the button electrode from antenna and capacitive coupling while allowing activating plunger entry. Furthermore, the small opening channels stray radiation about its periphery rather than admitting it to the button electrode.

3 Claims, 2 Drawing Sheets

MECHANICAL SHIELDING FOR ELECTRIC PRIMER

BACKGROUND OF THE INVENTION

This invention relates to a cartridge casing primer for projectile ammunition, as disclosed in prior copending application Ser. No. 07/874,156, now U.S. Pat. No. 5,208,423 filed Apr. 27, 1992, with respect to which the present application is a correct version.

Technology has long passed beyond percussion initiation of primers for shell cartridges having high rate of fire for military applications. Instead, primers containing pyrotechnic compositions are now electrically initiated. This initiation is accomplished by a relatively simple process of bringing a current-carrying plunger in the gun breech structure up behind the backside of the cartridge casing, once the cartridge is properly chambered, to electrically contact a button electrode therein for completing an electrical circuit through the primer button for initiating detonation of pyrotechnic composition in the circuit path. Detonation of the primer pyrotechnic composition in turn ignites propellant inside the cartridge casing.

Electrical initiation of cartridge primers is now common practice. Usually an explosive pyrotechnic material is made conductive and sandwiched between a pair of electrical conductors inside the primer. Current is passed through the pyrotechnic material from one conductor to the other to generate a temperature rise in the material sufficient to initiate its detonation. The detonating pyrotechnic material in turn ignites propellant in the cartridge casing to propel a projectile forward.

The electromagnetic environment aboard ships and aircraft, as well as on other military equipment, has increased substantially in recent years along with the increased use of electronic equipment. It is in this dense atmosphere of electromagnetic radiation that cartridges having electrically fired primers are stored, handled and used. High-power radar, for example, and communication equipment emit strong electromagnetic fields to the surrounding environment.

The problem of ammunition firing caused by stray or misdirected electromagnetic radiation has long been recognized. Numerous approaches have been proposed to alleviate or counter this condition. Prior art systems for electric fired primers have proposed inductive and capacitive components that form a balanced bridge to shunt unwanted signals. U.S. Pat. No. 3,181,464 discloses the use of special conductors, while U.S. Pat. No. 4,304,184 discloses the use of one or more inductors and ferrite beads to absorb unwanted current flow. RF attenuation is proposed in U.S. Pat. No. 4,848,233 by providing a conductive path in a special spiral shape with at least one reversal of direction embedded in ferrite material. Still other recent approaches are indicated in U.S. Pat. Nos. 4,893,563; 4,967,665; and 5,036,768. More recently, in U.S. Pat. No. 5,027,707 it is proposed to provide the conductive pyrotechnic mixture with a carbon layer to provide a parallel resistive current path in addition to the path through the conductive mixture.

Stray electromagnetic radiation can be coupled into an electroexplosive cartridge primer to initiate unwanted detonation. Propagation of radiated electromagnetic energy into the primer, requires a coupling mechanism from the external environment. Coupling mechanisms generally fall into one of three categories:

(1) antenna coupling, (2) capacitive coupling, or (3) aperture coupling.

Antenna coupling is a mechanism by which an electrically conductive object exposed to the external radiated electromagnetic environment transforms radiated energy into conducted energy and, if that object is allowed to contact a sensitive system element, transfers this energy to that sensitive element or component. Any electrically conductive object, e.g., wires, tools, human beings, etc., can act as unwanted antennas.

Capacitive coupling requires a conducting object (antenna) in proximity to a sensitive element (e.g., primer button). At frequencies from the upper end of the communications range through the lower end of the radar range, it is possible to couple RF energy by virtue of the capacitance that exists between external objects and the primer button.

Aperture coupling is a mechanism by which radiated electromagnetic energy couples directly from an external environment into sensitive system elements or components via holes, seams, or other openings. Generally, this entry path is more efficient at frequencies where the wavelength is small compared to the dimensions of the opening.

It is, therefore, an object of the invention to provide a cartridge electronic primer which minimizes opportunity of initiation by stray electromagnetic radiation.

SUMMARY OF THE INVENTION

In accordance with the present invention, an electric primer is provided which minimizes opportunity for antenna coupling, capacitive coupling, and aperture coupling of electromagnetic radiation to an electrode surface within a primer from an electromagnetically charged external environment. The electric primer is accordingly provided with an ignition button electrode spaced deep within the primer behind a limited access opening in its base end wall by means of an insulator of sufficient thickness to minimize ingress of stray electromagnetic radiation and antenna contact or capacitive coupling with the button electrode.

BRIEF DESCRIPTION OF DRAWING

Other objects, advantages and novel features of the invention will become apparent from the following detailed description of the invention when considered in conjunction with the accompanying drawing wherein.

DETAILED DESCRIPTION OF PREFERRED EMBODIMENT

Figure 1:
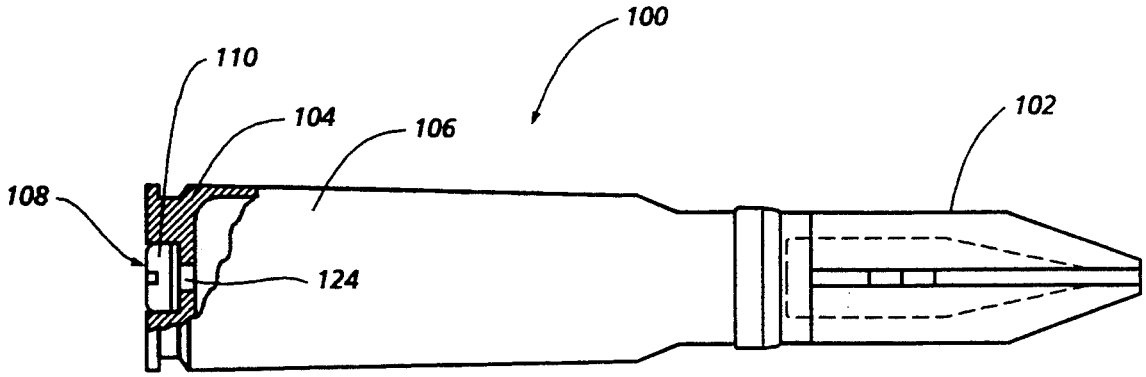
FIG. 1 is side view of a cartridge round with the base of the casing partially cut away to illustrate the location of an electric primer.

For a setting in which the present invention is adapted for use, is shown by FIG. 1 in a 20 mm cartridge 100 employing a sabot round 102. The aft end or base portion 104 of cartridge casing 106 is illustrated in cross-section to expose an electric primer, identified generally by the numeral 108, in position therein. Casing 106 is made of electrically conductive material such as brass, through which current flows when a circuit is completed for initiating detonation of pyrotechnic material in the primer.

Figure 2:
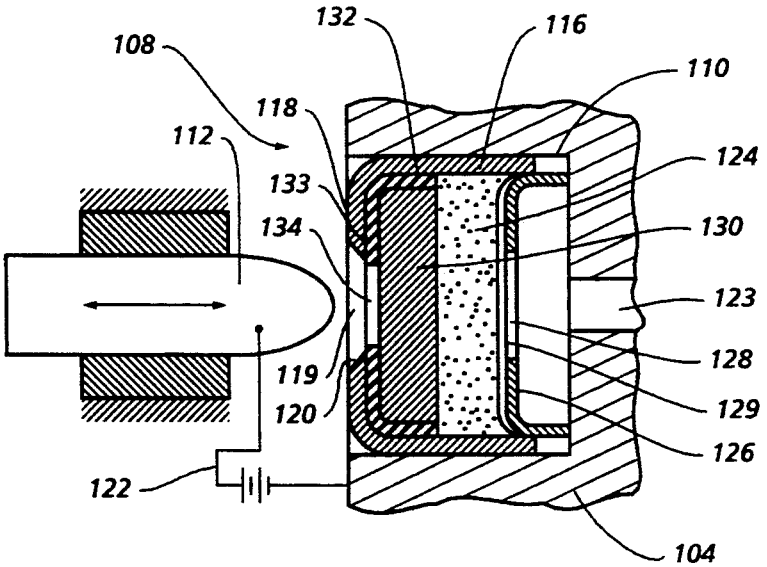
FIG. 2 is a greatly enlarged cross-sectional view of the improved primer positioned in a cartridge base recess with an electrode plunger adapted for making electrical contact to complete a firing circuit through the primer.

Referring now to FIG. 2, primer 108 is shown positioned in a recess 110 formed in casing base portion 104. Primer housing 116, also formed of conductive material, is designed to physically retain several components making up the primer 108. Primer housing 116 is in the form of a cup having an axially extending side wall and a flat end or base wall 118 which is provided with an opening 119 extending therethrough, preferably with a chamfered surface inlet 120 of a small effective diameter as shown. There is further illustrated in FIG. 2 a firing circuit 122 completed when plunger 112 is moved forward by a camming action (not illustrated), to trigger a pyrotechnic charge 124 within the primer.

Primer housing 116 is adapted to have its side wall pressfitted or otherwise secured in the cylindrical recess 110 of cartridge base 104, with its open end facing forward toward propellant (not illustrated) in the cartridge casing. A small axially disposed opening 123 is formed in base 104 for allowing the products of primer detonation to reach the propellant forwardly thereof in the casing.

Referring in more detail to the primer 108 as illustrated in FIG. 2, the electrically conductive material of pyrotechnic charge 124 is located inside housing 116 in electrical contact with its axially extended side wall. The pyrotechnic material is adapted to be detonated in response to sufficient current passed therethrough. The cup-shaped housing 116 according to one embodiment is provided with a slight taper along its side wall for receiving a cover 126 in press-fit. The central portion of cover 126 is provided with an opening 128, with a thin sheet or membrane 129 between the cover and pyrotechnic material of charge 124 to retain the charge in the housing prior to detonation as shown. A primer button electrode 130 is positioned in the housing 116 aft of pyrotechnic material with its forward side in electrical contact with the material. The aft portion of the button electrode terminates in a flat, generally planar surface which extends entirely thereacross in the illustrated embodiment and faces the generally planar inner face of base end wall 118 of housing 116. Insulating material 132, also in the form of a cup having a side wall and inturned end wall 133, encircles the periphery and aft portion of button 130 for spacing and electrically insulating it from the side and end walls of housing 116. End wall 133 thus spaces the aft facing surface of button electrode 130 from inturned end wall 118 a considerable distance, as illustrated in FIG. 2 for example, and as further detailed in FIG. 6. End wall 133 of the insulator 132 is provided with a central opening 134 which is coaxial with and of a smaller diameter than that of opening 119 as shown for allowing entry of firing plunger 112 to make electrical contact with the aft face of button electrode 130.

Figure 3:
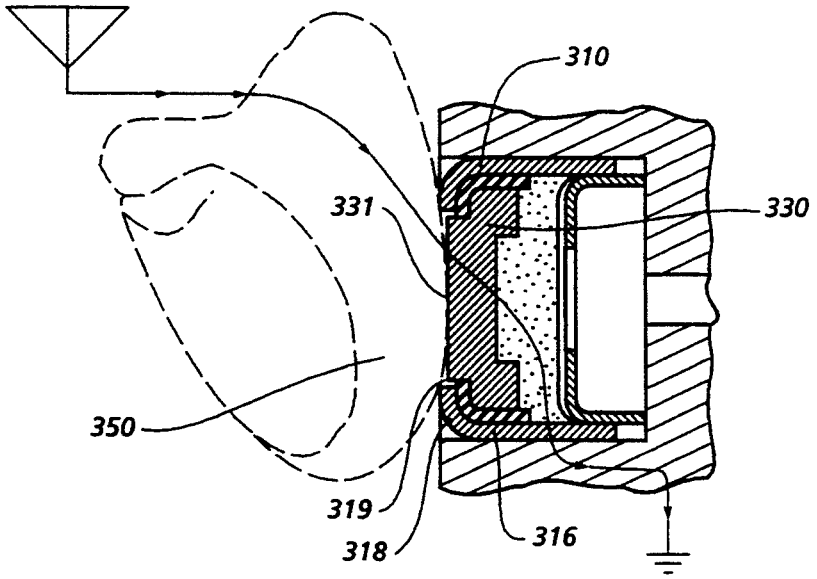
FIG. 3 PRIOR ART
FIG. 3 is a greatly enlarged cross-sectional view of a typical prior art primer in position within a cartridge casing, and with a finger of a human hand in contact with a button thereby completing a circuit for illustrating primer vulnerability to antenna coupling.
Figure 4:
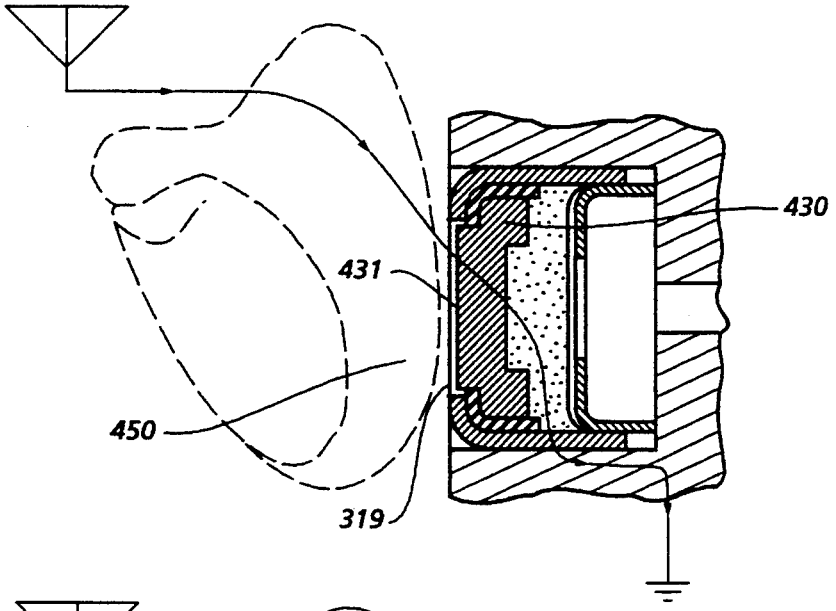
FIG. 4 PRIOR ART
FIG. 4 is another greatly enlarged cross-sectional view of the same FIG. 3 typical prior art primer in position within a cartridge casing, and with the human finger in proximity thereto for illustrating the primers vulnerability to capacitive coupling across a gap.

It will be seen, therefore, that aligned openings 119 and 134 are of relatively small diameters when compared to corresponding openings in the primer illustrated in FIGS. 3 and 4. Furthermore, it will be noted that the aft facing surface of button electrode 130 in FIG. 2 is deep-set within the primer housing relative to that illustrated in FIGS. 3 and 4. Openings 119 and 134 are of sizes sufficient to just allow entry of the tip of plunger 112 for contacting button electrode 130 to complete electrically powered circuit 122 through button 130, the pyrotechnic material of charge 124, and side wall of housing 116 to the base 104 of the cartridge casing.

The advantage of the primer design as presented in FIG. 2 is that it minimizes opportunity for antenna coupling, capacitive coupling, and aperture coupling when compared with previous primer designs, such as illustrated in FIGS. 3 and 4. Of radio frequency couplings into electrically fired primers, antenna coupling is most likely at the lower end of the radio frequency (RF) spectrum, i.e., at frequencies below 100 MHz. An example of antenna coupling is illustrated in FIG. 3 wherein primer housing 318 has a large end-opening 319 exposing a vast area of button electrode 330 which includes a protruding area 331 which is nearly flush with the outer extremity of housing base wall 318. It will be noted in FIG. 3, with the vast open exposure of electrode surface area 331, that direct contact with a human hand (finger 350) or tool (not illustrated) is easily made. In this case, the human body may act as an antenna and the hand or tool for carrying a charge directly to electrode 330. Thus, a circuit is completed to ground as indicated by the arrows, and the primer may be detonated. It will be noted in FIG. 5, where a human finger is illustrated adjacent the primer made according to the present invention, that actual contact with the electrode is not possible because button electrode 530 is deep set behind a small aperture, thus effectively preventing incidental contact, such as can occur when ammunition is being handled.

Aperture coupling is more likely to occur at frequencies above 100 MHz. The Navy's use of the RF spectrum can be divided into two ranges, the so-called HF communication range (2–30 MHz) and the radar range (200–40,000 MHz). Thus, the problems that result for a primer of the type employed in cartridges are attributable to antenna coupling at HF and aperture coupling at radar frequencies. Aperture coupling is a mechanism by which radiated electromagnetic energy couples directly from an external environment into sensitive elements or components via holes, seams, or other openings. Generally this entry path is more efficient at frequencies where wavelength is small compared to dimensions of opening(s). Navy radar, for example, generally operates between 200 and 10,000 MHz with corresponding wavelengths between 1.5 and 0.03 meters, respectively. For effective coupling, an opening would have to be greater than around one inch. In the present invention this opening is approximately one tenth of an inch (0.110″). Thus, coupling through a deep set opening of this size to reach the button electrode is not likely. Such would not be the case for the primer illustrated in FIGS. 3 and 4, wherein opening 319 (FIG. 3) is much greater and vast surface area 331 of electrode 330 is practically flush with the outer face of base wall 318.

There is a coupling transition region which overlaps antenna coupling and aperture coupling in which capacitive coupling can be a significant propagation mechanism. This effect is similar to antenna coupling except that direct contact with the button electrode is not necessary. Small separation distances between the antenna (finger 450 in FIG. 4, for example) and sensitive element (button electrode 430) can be electrically bridged by the capacitance between the two, and RF energy can couple via this capacitance bridge to ground as indicated by the arrows. Note in FIG. 4 the ease with which a human finger (or other tool) can approach surface 431 of relatively exposed button electrode 430. Note in FIG. 5 that finger contact with button electrode 530 is much less likely to occur because the electrode is deeply recessed behind small opening 519.

Total protection for electrical primers across the entire spectrum employed by Navy electronics requires that design measures address the three coupling possibilities. The present invention offers significant protection against all three, and thereby enhances the immunity of the primer to unintentional initiation across the RF spectrum.

Figure 5:
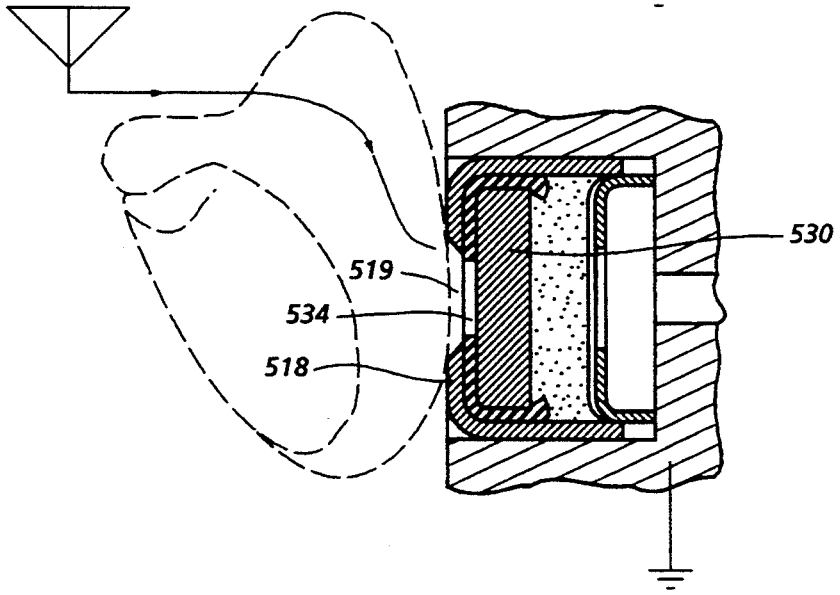
FIG. 5 is a greatly enlarged cross-sectional view of the improved primer in position in the shell casing with a human finger illustrated as unable to make antenna coupling or capacitive coupling with the primer button electrode.

The physical arrangement, terminology and relationship of various elements making up the invention will be apparent by reference to FIG. 5. With the aft surface of button electrode 530 deep set behind small openings 519 and 534, it will be appreciated that close proximity spacing or actual contact with button electrode 530 by an outside object, such as a conductive metal tool or a portion of the human hand, for capacitive coupling or antenna coupling, respectively, is not likely. With small opening 519 in the base wall and deep set button electrode 530, aperture coupling of electromagnetic radiation in the radar range is unlikely for the reasons heretofore indicated. It will be noted that the opening in the primer housing end wall is less than half the inside diameter of the side wall.

There has been presented in the drawings and supporting specification an electric primer which is less susceptible to initiation by stray electromagnetic radiation via antenna coupling, capacitive coupling, or aperture coupling. Extensive tests have been conducted on the new electric primer versus an electric primer previously employed by the Navy in like environments, and in all instances the new primer described herein was found to be superior. The results of these extensive tests for comparing firing thresholds for a previous primer as shown in FIGS. 3 and 4 designated as M52A3B1 and the new recessed button primer as shown in FIG. 5 according to the present invention are tabulated in the following Charts I and II, wherein *denotes that the primer was fired at that environmental level, while values preceded by >indicate the primer did not fire at maximum test environment.

| | HF FREQUENCIES | | |
|---|---|---|---|
| FREQUENCY (MHz) | TEST ENVIRON-MENT (V/m) | M52A3B1 THRESHOLD (V/m) | RECESSED BUTTON THRESHOLD (V/m) |
| 4.040 | 200 | 75* | >200 |
| 4.803 | 200 | 100* | >200 |
| 5.383 | 200 | 100* | >200 |
| 6.400 | 200 | 5* | 100* |
| 6.970 | 200 | 15* | >200 |
| 7.595 | 200 | 20* | >200 |
| 9.050 | 200 | 5* | 200* |
| 9.803 | 200 | 7.5* | >200 |

-continued

| | HF FREQUENCIES | | |
|---|---|---|---|
| FREQUENCY (MHz) | TEST ENVIRON-MENT (V/m) | M52A3B1 THRESHOLD (V/m) | RECESSED BUTTON THRESHOLD (V/m) |
| 11.054 | 200 | 15* | >200 |
| 12.045 | 200 | 50* | >200 |
| 13.530 | 200 | 100* | >200 |
| 16.060 | 200 | 25* | >200 |
| 17.048 | 150 | 10* | >150 |
| 18.036 | 150 | 20* | >150 |
| 19.270 | 200 | 75* | >200 |
| 20.510 | 200 | 60* | >200 |
| 21.460 | 200 | 100* | >200 |

| | HF FREQUENCIES | | |
|---|---|---|---|
| FREQUENCY (MHz) | TEST ENVIRON-MENT (V/m) | M52A3B1 THRESHOLD (V/m) | RECESSED BUTTON THRESHOLD (V/m) |
| 23.180 | 200 | 40* | >200 |
| 24.450 | 173 | 20* | >173 |
| 26.875 | 200 | >200 | Not Tested |

| | RADAR FREQUENCIES | | |
|---|---|---|---|
| FREQUENCY (MHz) | TEST ENVIRON-MENT ($mW/cm^2$) | M52A3B1 THRESHOLD ($mW/cm^2$) | RECESSED BUTTON THRESHOLD ($mW/cm^2$) |
| 215 | 20.4 | 0.625* | >20.4 |
| 425 | 67 | 0.5* | >67 |
| 2720 | 400 | >400 | >400 |
| 2900 | 400 | >400 | >400 |
| 5650 | 400 | 160* | >400 |
| 7800 | 150 | >150 | >150 |

TEST RESULTS

The test environment was generated electromagnetic radiation for essentially assimilating the electromagnetic environment that would be present on board ship, aircraft, or helicopters. At least one primer of each model M52A3B1 and one recessed button electrode model (Goetz) was tested at each frequency. The test results shown in Charts I and II best speak for themselves in illustration that the present invention (Goetz recessed button) was more effective than the Navy's previously used primer (model M52A3B1) in reducing detonation from radiation at like levels. Note, for example, that at a frequency of 4.040 MHz in the environment of 200 volts/meter, the lowest threshold at which at least one primer of model M52A3B1 fired was 75 volts/meter, whereas none of the recessed button primers (Goetz) fired at the maximum environment level. It will be noted in Chart I that at least one model M52A3B1 primer fired at every test frequency at environment level far below the 200 volts/meter criteria test environment from 4.040 MHz through 24.450 MHz. At the 26.875 MHz level, one model M52A3B1 primer fired at 200 volts/meter. No recessed button primer was tested at this level. Of all the recessed button primers tested, only two fired, one at 100 volts/meter and another at 200 volts/meter. However, compare these firing levels with the firing levels of model M52A3B1 primers.

In the radar frequency range of 215 MHz to 7800 MHz, where primers were tested and recorded in Chart II, it will be noted that none of the Goetz recessed button primers fired, while three model M52A3B1 primers fired at threshold levels substantially lower than the level where the Goetz primers did not fire. Various test configurations were selected to create the most stressful conditions at each frequency.

Modifications and variations to the present invention are possible in light of the foregoing teachings. It is, therefore, to be understood that within the scope of the appended claims the invention may be practiced otherwise than as specifically described.

What is claimed is:

1. In combination with a cartridge case having a base portion with an aft facing recess therein, a primer received in said recess comprising: an electrically conductive housing having an end wall and a side wall extending axially therefrom adapted to be fitted into the recess of the base portion, said end wall having an inner face and an opening therein allowing entry of an electrically activating plunger into the housing, an electrically conductive pyrotechnic charge disposed within the housing in electrical contact with the side wall thereof, a button electrode disposed entirely within the housing in electrical contact with the pyrotechnic charge, said button electrode having an aft facing surface adapted to be contacted by the plunger in response to said entry thereof into the housing, insulating means within the housing for spacing said aft facing surface of the button electrode inwardly from the inner face of the end wall to minimize possible coupling between stray electromagnetic radiation and the button electrode and a cover enclosing the pyrotechnic charge within the housing, the side wall of the housing having a surface tapered to receive the cover therein with a tight fit.

2. In combination with a cartridge case having a base portion with an aft facing recess therein, a primer received in said recess comprising: an electrically conductive housing having an end wall and a side wall extending axially therefrom adapted to be fitted into the recess of the base portion, said end wall having an inner face and an opening therein allowing entry of an electrically activating plunger into the housing, an electrically conductive pyrotechnic charge disposed within the housing in electrical contact with the side wall thereof, a button electrode disposed entirely within the housing in electrical contact with the pyrotechnic charge, said button electrode having an aft facing surface adapted to be contacted by the plunger in response to said entry thereof into the housing, insulating means within the housing for spacing said aft facing surface of the button electrode inwardly from the inner face of the end wall to minimize possible coupling between stray electromagnetic radiation and the button electrode and retaining means received in the housing with a press fit for enclosing therein the pyrotechnic charge.

3. The combination of claim 2 wherein said retaining means includes a cover, the side wall of the housing being tapered to enable the cover to be received with said press fit in engagement therewith and thereby retain the pyrotechnic charge enclosed in the housing prior to detonation thereof.

* * * * *